US007929721B2

(12) United States Patent
Knapp et al.

(10) Patent No.: US 7,929,721 B2
(45) Date of Patent: Apr. 19, 2011

(54) HEARING AID WITH DIRECTIONAL MICROPHONE SYSTEM, AND METHOD FOR OPERATING A HEARING AID

(75) Inventors: Benno Knapp, Erlangen (DE); Hartmut Ritter, Neunkirchen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 796 days.

(21) Appl. No.: 11/876,142

(22) Filed: Oct. 22, 2007

(65) Prior Publication Data

US 2008/0044046 A1 Feb. 21, 2008

Related U.S. Application Data

(62) Division of application No. 09/979,966, filed as application No. PCT/EP00/04648 on May 22, 2000, now Pat. No. 7,324,649.

(30) Foreign Application Priority Data

Jun. 2, 1999 (DE) ..... 199 25 392

(51) Int. Cl.
*H04R 25/00* (2006.01)

(52) U.S. Cl. ..... 381/313; 381/312

(58) Field of Classification Search ..... 381/23.1, 381/312–313, 316–317, 320–321
See application file for complete search history.

(56) References Cited

U.S. PATENT DOCUMENTS

| | | | | |
|---|---|---|---|---|
| 4,399,327 | A | 8/1983 | Yamamoto et al. | |
| 4,703,506 | A | 10/1987 | Sakamoto et al. | |
| 4,751,738 | A | 6/1988 | Widrow et al. | |
| 4,773,095 | A | 9/1988 | Zwicker et al. | |
| 5,121,426 | A | 6/1992 | Baumhauer, Jr. et al. | |
| 5,226,087 | A | 7/1993 | Ono et al. | |
| 5,463,694 | A | 10/1995 | Bradley et al. | |
| 5,473,701 | A | 12/1995 | Cezanne et al. | |
| 5,524,056 | A | 6/1996 | Killion et al. | |
| 5,715,319 | A | 2/1998 | Chu | |
| 5,754,661 | A | 5/1998 | Weinfurtner | |
| 5,757,933 | A | 5/1998 | Preves et al. | |
| 5,793,875 | A | 8/1998 | Lehr et al. | |
| 5,844,992 | A | 12/1998 | Boyer | |
| 6,041,127 | A | 3/2000 | Elko | |
| 6,154,552 | A | 11/2000 | Koroljow et al. | |
| 6,240,192 | B1 * | 5/2001 | Brennan et al. | 381/314 |
| 6,339,758 | B1 | 1/2002 | Kanazawa et al. | |
| 6,603,861 | B1 | 8/2003 | Maisano et al. | |
| 6,606,391 | B2 | 8/2003 | Brennan et al. | |
| 6,766,029 | B1 | 7/2004 | Maisano | |
| 7,103,191 | B1 | 9/2006 | Killion | |

FOREIGN PATENT DOCUMENTS

| | | |
|---|---|---|
| EP | 0 186 996 | 3/1993 |
| EP | 0 820 210 | 1/1998 |
| EP | 0 924 958 | 6/1999 |
| WO | WO 94/24834 | 10/1994 |

* cited by examiner

*Primary Examiner* — Suhan Ni

(74) *Attorney, Agent, or Firm* — Schiff Hardin LLP

(57) ABSTRACT

The invention relates to a hearing aid with a signal processing unit and at least two microphones which can be coupled together to form directional microphone systems of a different order, where microphone signals emitted by directional microphone systems of a different order can be coupled together in a weighting dependent on the frequency of the microphone signals. The invention further relates to a method for operating a hearing aid of this type.

2 Claims, 3 Drawing Sheets

HEARING AID WITH DIRECTIONAL MICROPHONE SYSTEM, AND METHOD FOR OPERATING A HEARING AID

CROSS-REFERENCE TO RELATED APPLICATIONS

This application is a divisional of parent application Ser. No. 09/979,966, filed Nov. 27, 2001 now U.S. Pat. No. 7,324,649, which is a national stage entry of PCT application no. PCT/EP00/04648, filed May 22, 2000. These applications are herein incorporated by reference.

BACKGROUND

The invention relates to a hearing aid with a signal processing unit and at least two microphones which can be coupled together to form directional microphone systems of a different order. The invention further relates to a method for operating a hearing aid.

Hearing aids with at least two microphones for obtaining directional microphone characteristics of a first or higher order are known in the prior art. When directional microphone systems of a second or higher order are used, an unwanted drop in the directivity index (DI) occurs in individual frequency ranges of the input signal.

In hearing aids, the frequency range of 100 Hz to 6 kHz is of particular interest in improving hearing. Using this frequency range in directional microphone systems of a first order, a directivity index is obtained which falls slightly in the direction of higher frequencies. At lower frequencies, for example up to 1 kHz, DI values of about 5 dB are obtained. However, because of the high degree of sensitivity to component tolerances, directional microphone systems of n-th order with n>1 have a negative directivity index at low frequencies. However, DI values of 7 dB and more can be achieved for frequencies of 1 kHz to 5 kHz. In order to be able to obtain higher DI values for low frequencies too, it is necessary to keep to narrow component tolerances (e.g., the phase difference of the microphones to <0.25°) which can best be achieved with silicon microphone arrays. However, at the supply voltage (<1V) used for hearing aids, these arrays have too great of a signal-to-noise ratio, which makes them not yet practicable.

U.S. Pat. No. 5,757,933 discloses a hearing aid in which it is possible to switch manually between a microphone of zero order (a microphone without directivity) and a microphone system of first order. In this device, the person wearing the hearing aid performs the switching.

SUMMARY

It is an object of the invention to provide a hearing aid and a method for operating a hearing aid, in which a high directivity index is achieved across a large frequency range of the input signal.

This object is achieved by a hearing aid, comprising a signal processing unit; and at least two microphones coupled together to form directional microphone systems of a different order, these systems configured to emit microphone signals that can be coupled together in a weighting dependent on a frequency of these microphone signals. This object is also achieved by a method for operating a hearing aid, comprising providing a signal processing unit; providing at least two microphones; coupling together the microphones to form directional microphone systems of a different order; generating microphone signals by the directional microphone systems; coupling together the generated microphone signals with a weighting dependent on a frequency of the microphone signals in the signal processing unit; and providing an output signal from said signal processing unit for further processing. Further developments of the invention are detailed below.

The hearing aid according to the invention includes at least two microphones in order to be able to realize directional microphone systems of a zero, first, or higher order. A directional microphone system of zero order within the meaning of the invention is to be understood as a microphone system without directivity, for example an omnidirectional microphone not coupled to other microphones. With directional microphone systems of a first order, a theoretically attainable maximum value of the DI of 6 dB (hypercardioid) can be achieved. In practice, DI values of 4-4.5 dB are achieved using KEMAR (a standard research dummy) with an optimum positioning of the microphones and the best equalization of the signals generated by the microphones. Directional microphone systems of a second and higher order have DI values of 10 dB and more, which are advantageous for, e.g., better speech audibility.

If a hearing aid includes, for example, three omnidirectional microphones, directional microphone systems of a zero to a second order can be formed. Thus, microphone signals with directional characteristics of a zero to a second order can be derived simultaneously from these directional microphone systems.

According to the invention, the microphone signals emitted by microphone systems of a different order are advantageously weighted differently, depending on the frequency, and added together. Thus, for example, in a hearing aid with directional microphone systems of a first and a second order, mainly the microphone signal of the first order is further processed at low frequencies, and mainly the microphone signal of the second order is further processed at higher frequencies. The weighting is preferably done by filter elements, the microphone signal of the directional microphone system of the first order being subjected to low-pass filtering, and the microphone signal of the directional microphone system of the second order being subjected to high-pass filtering. In general, at low frequencies, mainly the microphone signal of the directional microphone of the first order is conveyed onward for further processing and, at high frequencies, mainly the microphone signal of the directional microphone system of the n-th order is conveyed onward for further processing, where n stands for the highest occurring order. In the middle frequency range, mainly the microphone signals of the directional microphone systems between the first and the highest occurring order are preferably further processed.

In one embodiment of the invention, the limit frequencies of the filter elements downstream of the directional microphone systems are adjustable. By setting the limit frequencies in the audible frequency range, e.g., up to 10 kHz, and by the associated frequency-dependent selection of directional microphone systems of a different order, directivity characteristics can be obtained for the whole system which are markedly superior to conventional hearing aids, when considered across the entire frequency range. Thus, for each frequency of the input signal, an optimized directivity can be obtained.

Modern hearing aids allow the acoustic input signal to be divided into channels. This permits, among other things, different strengthening of individual frequency ranges. In an advantageous embodiment of the invention, the limit frequencies of the filter elements downstream of the directional microphone systems are coupled to channel limit frequencies of the hearing aid. In the simplest case, each directional microphone system forms a channel. The filter elements for weighting the microphone signals then at the same time effect the channel division, so that it is possible to dispense with additional filter elements for channel division.

Besides one-off adjustment of the limit frequencies, for example, when fitting the hearing aid, the position of individual or of several limit frequencies can also be set to the particular situation and continuously checked and adjusted. This provides for optimized adaptation to different useful noise/interference noise situations. The analysis of the environmental situation is preferably effected using a neuronal network and/or a fuzzy logic control.

The limit frequencies and the overall directional characteristics of the microphone system of a hearing aid according to the invention can also be adjusted differently depending on the hearing program which has been set. Here, for a defined frequency range, at least mainly a microphone signal of zero order (microphone signal without directivity) can also be further processed.

DESCRIPTION OF THE DRAWINGS

Further details of the invention are explained in greater detail below on the basis of the illustrative embodiments shown in the drawings.

DETAILED DESCRIPTION OF THE PREFERRED EMBODIMENTS

Figure 1:
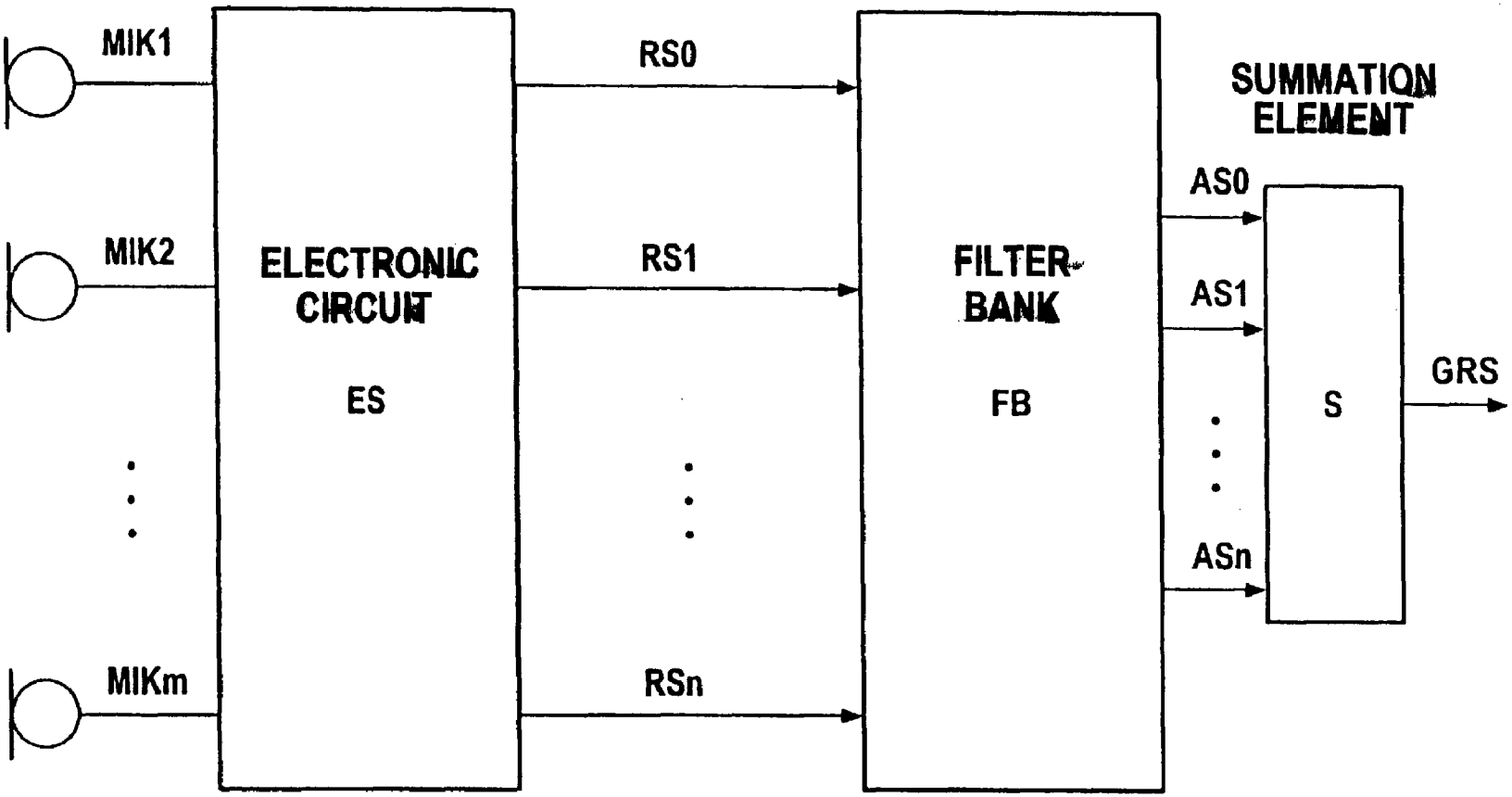
FIG. 1 is a basic circuit diagram for generation and frequency-dependent combination of directional microphone systems of a different order.

In the basic circuit diagram shown in FIG. 1, the microphones of a hearing aid have been labeled as MIK1, MIK2 . . . , MIKm. To form directional microphone systems of a different order, the output signals of the microphones are coupled together in an electronic circuit ES. The electronic circuit arrangement ES for formation of directional microphone systems can include electronic components such as delay elements, adding elements or inverters. The directional microphone signals thus formed at the output of the electronic circuit ES are labeled as the directional microphone signal of the zeroth order RS0, directional microphone signal of first order RS1, up through the directional microphone signal of n-th order RSn. A plurality of directional microphone signals of the same order can also be formed. In the hearing aid according to the invention, however, at least two directional microphone signals differ in respect of their order. For further processing of the directional microphone signals, the latter are fed to a filter bank FB. The filter bank FB has filter elements, for example high-pass, low-pass or bandpass filters. The directional microphone signals are attenuated differently using the filter bank FB as a function of their order and their signal frequency. The limit frequencies and filter coefficients of the individual filter elements are preferably adjustable. The output signals (AS0, AS1 . . . ASn) of the filter bank FB are fed to a summation element S to form the overall directional microphone signal GRS.

The illustrated basic circuit diagram for processing the microphone signals of a hearing aid can be realized using digital and analog circuit technology. Further components, such as A/D converters, D/A converters, switches, amplifiers, etc. (not shown here), can also be situated between the individual elements.

In general, the circuit will be set up in such a way that, up to a lower limit frequency fg1, for example 1 kHz, at least mainly the directional microphone signal of first order is conveyed onward. As the frequency increases, directional microphone signals of higher order are increasingly added and mixed to the directional microphone signal of first order and the directional microphone signals of lower order are possibly even attenuated.

It can thus happen that, above a certain limit frequency fg2 at the output of the summation element S, at least mainly the directional microphone signal with the highest occurring order is alone conveyed onward.

Figure 2:
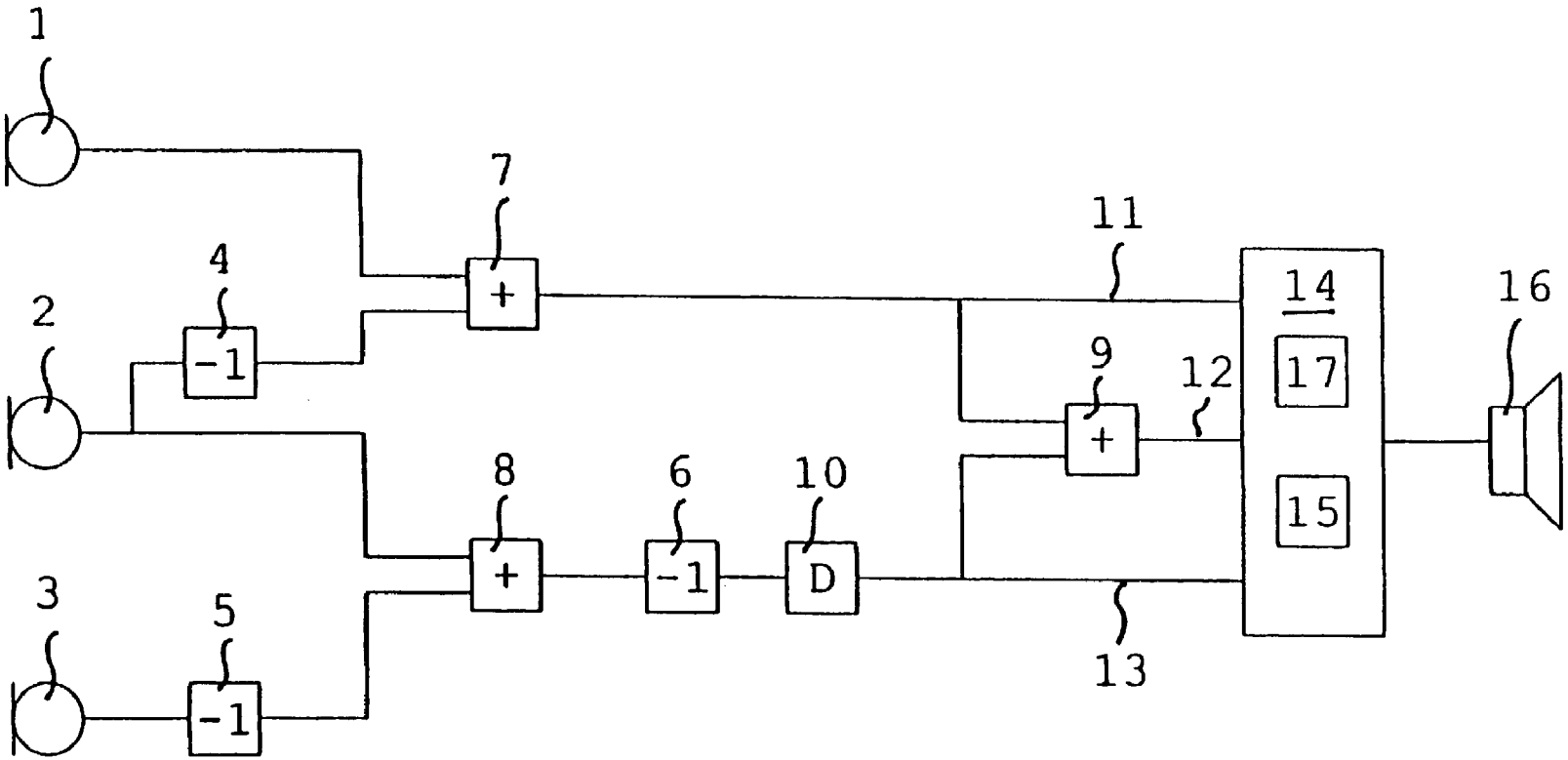
FIG. 2 is a schematic circuit diagram of a hearing aid with three microphones.

FIG. 2 shows as illustrative embodiment a hearing aid with three microphones 1, 2 and 3. Signal line 11 carries a signal of a system of the first order with the directional microphone characteristic "undelayed eight" when the input signals of the microphones 1, 2 are added via the summation element 7 after inversion in the inverter 4.

Signal line 13 carries a signal with the directional microphone characteristic "delayed eight" of a directional microphone system of the first order when the signals of the microphones 2 and 3 are added in the summation element 8, after inversion of the signal of the microphone 3 in the inverter 5, and are subsequently inverted in the inverter 6 and delayed in the delay element 10.

The microphone pairs 1, 2 and 2, 3 illustrated in FIG. 2 thus in each case form a directional microphone system of a first order.

These signals of the directional microphone systems of the first order are further processed (channel-specifically) in a signal processing unit 14 and fed as an output signal to the loudspeaker 16.

By suitably coupling all three microphones, the circuit diagram according to FIG. 2 also permits realization of a directional microphone system of a second order, the signals of the signal lines 11, 13 being combined in the summation element 9 to the signal line 12.

The signal processing unit 14 includes a filter element 17 and a setting element 15 for setting at least one limit frequency of the filter element 17.

Depending on a limit frequency fg set in the setting element 15 of the signal processing unit 14, further processing of the signals in the signal lines 11 or 13 can be carried out at signal frequencies $f<fg$ by the signal processing unit 14. If the signal frequency exceeds the limit frequency fg, the filter element 17 effects mainly the further processing of the signal of the signal line 12, hence a signal of a directional microphone system of second order.

For this purpose, the signal lines 11 and 13 are coupled in the filter element 17 to low-pass filters, while the signal line 12 is fed to a high-pass filter. The filtered signals are added at the output of the filter element 17 (not shown).

This avoids a drop in the DI when the signal frequency is below the limit frequency fg. The advantageous courses of the DI of the systems of a first and second order are combined across the entire frequency range (see FIG. 3).

Neural networks and fuzzy logic controls can be provided in the signal processing unit 14 in order to repeatedly determine, and if appropriate continuously adapt, the limit frequencies fg to the particular situation by signal-analytical evaluation of the useful noise/interference noise situation.

Figure 3:
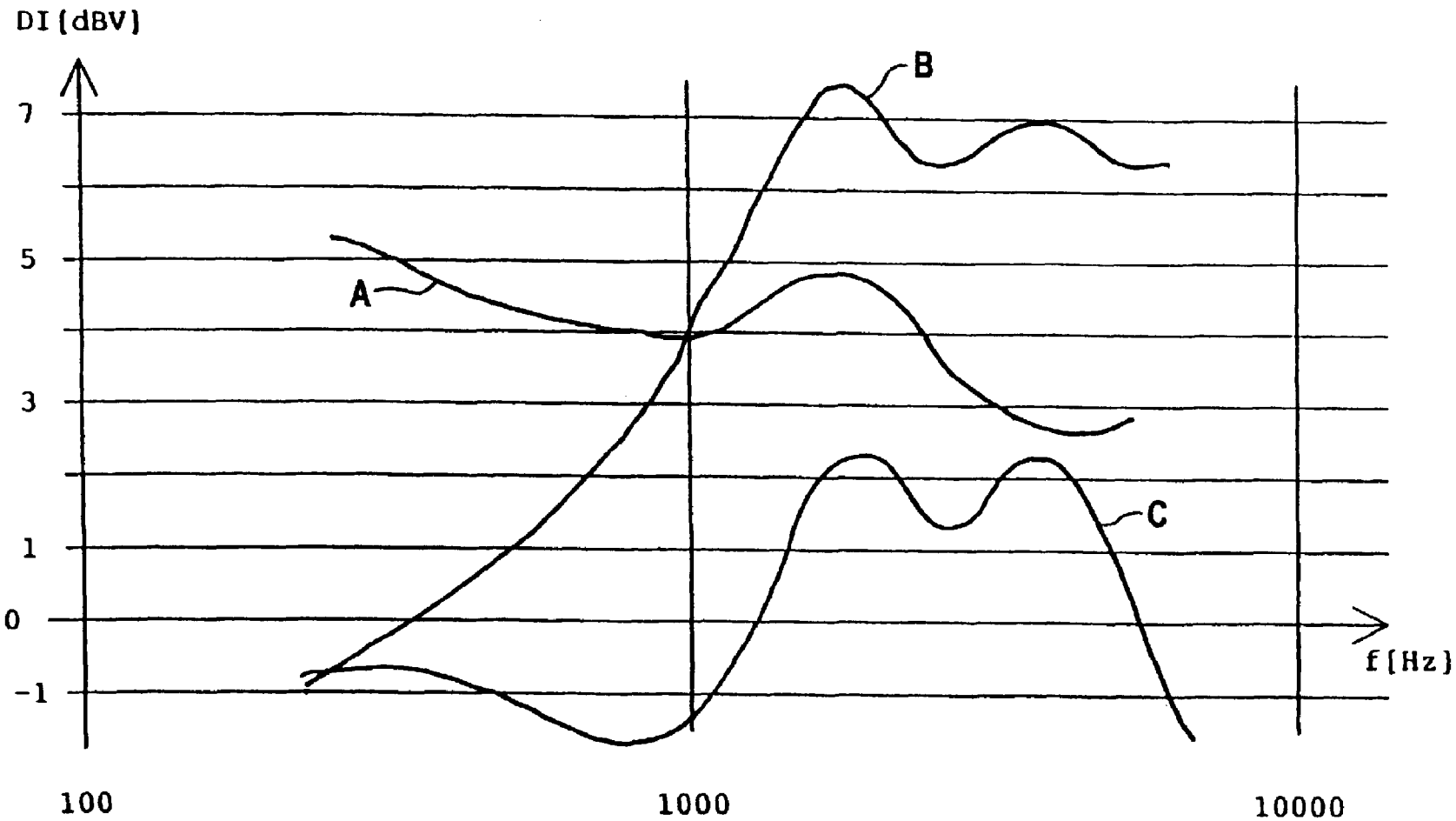
FIG. 3 is a graph illustrating a frequency-specific course of the directivity index (DI).

FIG. 3 shows the different courses of the DI across the frequency range to be processed. To ensure that the DI values remain at the highest possible level across the entire frequency range, signal processing at frequencies below the limit frequency fg=1000 Hz yields mainly to a system of first order with the DI course A.

Above the limit frequency fg=1000 Hz, mainly the signal of a directional microphone system of second order is conveyed with the DI course B, which achieves higher DI values than the system of first order. For comparison, the DI course C is shown of a person with normal hearing without the help of technical aids, simulated using KEMAR.

The limit frequency fg=1000 Hz advantageously corresponds to the limit frequency fg of a two-channel signal processing system, which has a first signal processing channel for signal frequencies up to 1000 Hz and a second channel for frequencies over 1000 Hz.

The above-described method and apparatus are illustrative of the principles of the present invention. The frequencies discussed above are exemplary and suitable values known by those of ordinary skill in the art should be considered as encompassed by the invention. Numerous modifications and adaptations will be readily apparent to those skilled in this art without departing from the spirit and scope of the present invention.

What is claimed is:

1. A hearing aid comprising:

at least two microphones that respectively receive incoming audio signals;

a coupling circuit that couples said at least two microphones together to form a plurality of simultaneously operating directional microphone systems respectively of different orders, each of said plurality of microphone systems emitting a microphone system output signal; and a signal processor that receives the respective microphone system output signals, said signal processor being configured to differently process the respective microphone system output signals with respectively different frequency weightings that maximize a directivity index across a total frequency range of all of the respective microphone system output signals.

2. A method for operating a hearing aid, comprising the steps of:

with at least two microphones, respectively receiving incoming audio signals;

in a coupling circuit, coupling said at least two microphones together to form a plurality of simultaneously operating directional microphone systems respectively of different orders, each of said plurality of microphone systems emitting a microphone system output signal; and providing a signal processor with the respective microphone system output signals, and in said signal processor, differently processing the respective microphone system output signals with respectively different frequency weightings that maximize a directivity index across a total frequency range of all of the respective microphone system output signals.

* * * * *